US009628930B2

(12) United States Patent
Tsang

(10) Patent No.: US 9,628,930 B2
(45) Date of Patent: Apr. 18, 2017

(54) AUDIO SPATIAL EFFECT ENHANCEMENT

(75) Inventor: Peter Wai Ming Tsang, Hong Kong (CN)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 1388 days.

(21) Appl. No.: 12/756,586

(22) Filed: Apr. 8, 2010

(65) Prior Publication Data

US 2011/0249820 A1 Oct. 13, 2011

(51) Int. Cl.
*H04S 5/02* (2006.01)
*H04S 3/00* (2006.01)
*H04S 1/00* (2006.01)

(52) U.S. Cl.
CPC ..... *H04S 1/002* (2013.01)

(58) Field of Classification Search
CPC ..... H04S 1/002; H04S 5/00; H04S 2420/01; H04S 3/002; H04R 1/26; H04B 1/1676
USPC ... 381/1, 17–19, 21, 27, 300, 303, 306–307, 381/310, 61
See application file for complete search history.

(56) References Cited

U.S. PATENT DOCUMENTS 4,748,669 A 5/1988 Klayman
4,866,774 A 9/1989 Klayman
4,910,778 A 3/1990 Barton
5,671,287 A * 9/1997 Gerzon ..... H04S 5/00 381/1
5,892,830 A 4/1999 Klayman
5,970,153 A 10/1999 Petroff
7,010,129 B1 3/2006 Schaaf et al.
7,146,010 B1 * 12/2006 Heed ..... H04R 5/04 381/1
2006/0062405 A1 * 3/2006 McKee Cooper ..... G01S 11/14 381/103
2008/0170711 A1 * 7/2008 Breebaart ..... G10L 19/008 381/77
2010/0217585 A1 * 8/2010 Karlsson ..... G10L 19/008 704/219

FOREIGN PATENT DOCUMENTS

GB 0603545.5 2/2006
WO 2007096610 A1 8/2007

OTHER PUBLICATIONS

Gunnarsson. "Single Bipolar Loudspeaker System for Stereo Reproduction", http://www.embracingsound.com/docs/SingleBipolarLoudspeakersystemforstereoreproductionb0.91.pdf. Last accessed Apr. 14, 2010, 10 pages.

(Continued)

*Primary Examiner* — George Monikang
(74) *Attorney, Agent, or Firm* — Amin, Turocy & Watson, LLP

(57) ABSTRACT

The disclosed subject matter relates to an architecture that can facilitate generation of enhanced spatial effects for stereo audio systems. Such can be accomplished by integrating on top ambience signal boosting employed in conventional systems. In particular, the ambience signal can be transformed according to a time-dependent function, which can simulate the auditory impressions of a real-world listening environment that may contain static, regularly moving, and/or irregular moving elements.

25 Claims, 12 Drawing Sheets

(56) References Cited

OTHER PUBLICATIONS

Gunnarsson. "EmbracingSound™ Tech Summary", http://www.embracingsound.com/docs/EmbracingSoundTechSummary.pdf. Last accessed Apr. 14, 2010, 13 pages.
Levitin, "The Illusion of Music", http://newsgroups.derkeiler.com/Archive/Rec/rec.music.opera/2008-08/msg01452.html, Feb. 23, 2008, New Scientist Print Edition, 6 pages.

* cited by examiner

AUDIO SPATIAL EFFECT ENHANCEMENT

BACKGROUND

In conventional stereo audio systems, the perceived sound image projected from a pair of loudspeakers can be enhanced or widened by boosting the ambience signal. It is well known that the ambience signal can be obtained from the difference between the left (L) and the right (R) signals of the original source audio. As a result, an audience can feel the ambience signals when they arrive at the right and left ears with different phase shifts. A number of systems have applied this phenomenon to widen the spatial effect in stereo audio systems. These findings are useful in reconstructing enhanced stereo sounds with closely spaced loudspeakers.

A number of improvements have also been made by other systems taking into account of the frequency spectrum and the amplitude of the audio signals that are generated. While there is little doubt about the effectiveness of these techniques, which are well formulated and evaluated, the impressions created on different individuals, and with different kinds of audio, can be diverse. For instance, some audiences may feel weaker sound along certain direction(s). Moreover, stereo signals which have a smaller difference between the left and right channels will generally produce a much weaker enhancement effect. Other factors such as discrepancy in the loudspeakers and listening positions may also play a part in a practical situation.

However, the above mentioned problems may not be obvious when an audience is placed in some real world listening environments, even if he or she is presented with the same stereo signals. One reason for this is that because the ambience signals derived from a dynamic listening environment may be comprised of a complicated juxtaposition of both static and moving ingredients. For example, the movement of objects and people can affect the reflection and reverberation of the acoustic signals. Similarly, movement of the musicians or the musical instruments will often change the impression on the sources of these signals. Accordingly, it is difficult, if not impossible, to impart the desired impressions on the listeners with a spatial enhancement method that processes the source stereo signals in a stationary and deterministic manner.

SUMMARY

The following presents a simplified summary of the disclosed subject matter in order to provide a basic understanding of some aspects of the disclosed subject matter. This summary is not an extensive overview of the disclosed subject matter. It is intended to neither identify key or critical elements of the disclosed subject matter nor delineate the scope of the disclosed subject matter. Its sole purpose is to present some concepts of the disclosed subject matter in a simplified form as a prelude to the more detailed description that is presented later.

The subject matter disclosed herein, in one or more aspects thereof, comprises an architecture that can enhance audio spatial effects. In accordance therewith and to other related ends, the architecture can employ a receiving component configured to receive a summation signal and an ambience signal. The summation signal can be constructed as a sum of a left signal of a source stereo signal and a right signal of the source stereo signal. In contrast, the ambience signal can be constructed as a difference between the left signal and the right signal.

The architecture can further employ an audio enhancement component configured to generate an enhanced output signal based upon the received summation signal and ambience signal. In addition, in some aspects, the audio enhancement component can itself generate the summation signal and the ambience signal, e.g., with access to the source stereo signal. Regardless, the enhanced output signal can include a left output signal and a right output signal, and can be generated by modulating the summation signal with a time-dependent function.

Hence, the architecture can at least partially conceal, rather than eliminate, the above mentioned problems, e.g., by adding an audio illusion, on top of the spatial widening effect, which is achieved by boosting the difference of the stereo signals. In essence, the sum (e.g., summation signal) and the difference (e.g., the ambience signal) of the left and right channels of the original stereo signal can be obtained with digital or analogue means. These summation and ambience signals can then each be modulated with a time-varying function, resulting in a new pair of stereo signals. When the new left and right signals are reconstructed with a pair of loudspeakers, which may be spaced closely or widely apart, the spatial perception can be further enhanced. Furthermore, the modulation of the summation and ambience signals with the pair of time-varying functions can generate the impression of disparate sound sources contained in the original audio signal being shifted or rotated around the audience in a continuous manner.

Such mechanism can increase the auditory pleasure as one listens to the processed audio, e.g., by perceiving more robust 3D effects through a dynamic variation of the sound field, and a more uniform distribution of different sound sources. These features can aid in concealing the non-uniform spatial enhancement as perceived by some audiences subjected to conventional spatial widening schemes, as well as aid in concealing the non-ideal characteristics of the loudspeakers and their configurations, the lack of substantial difference between the left and right channels (in the extreme case, mono-signals), and the listening environment itself.

The following description and the annexed drawings set forth in detail certain illustrative aspects of one or more non-limiting embodiments. These aspects are indicative, however, of but a few of the various ways in which the principles of the claimed subject matter may be employed and the claimed subject matter is intended to include all such aspects and their equivalents. Other advantages and distinguishing features of the claimed subject matter will become apparent from the following detailed description of the various embodiments when considered in conjunction with the drawings.

DETAILED DESCRIPTION

Figure 1:
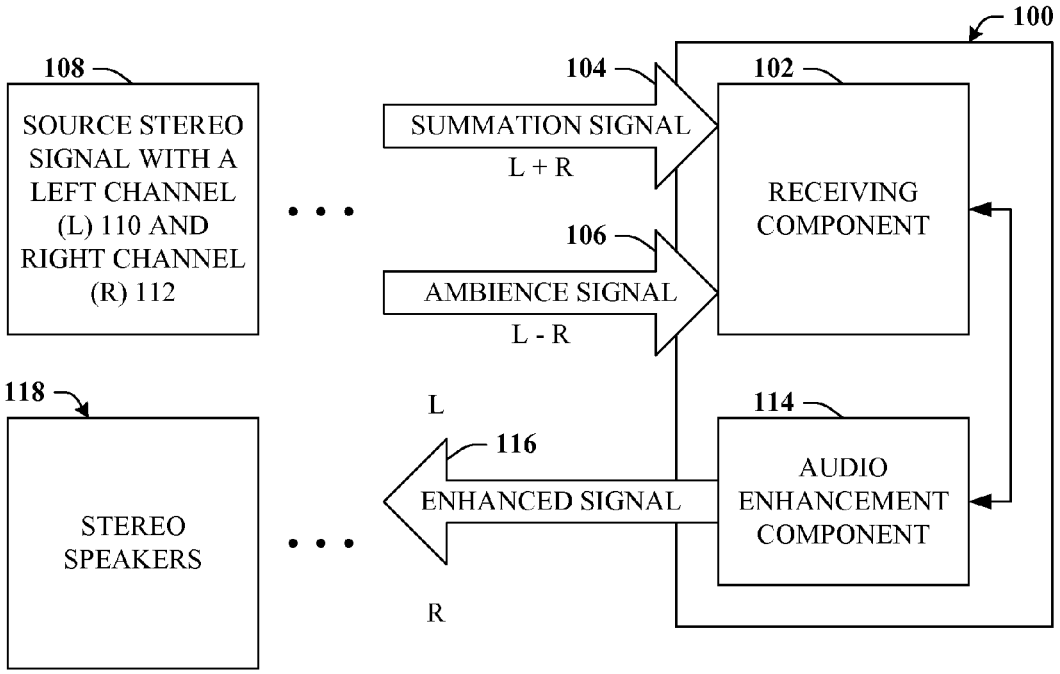
FIG. 1 illustrates a block diagram of a computer-implemented system that can enhance audio spatial effects.

One or more embodiments are now described with reference to the drawings, wherein like reference numerals are used to refer to like elements throughout. In the following description, for purposes of explanation, numerous specific details are set forth in order to provide a thorough understanding of the various embodiments. It may be evident, however, that the claimed subject matter may be practiced without these specific details. In other instances, well-known structures and devices are shown in block diagram form in order to facilitate describing the various embodiments.

What is disclosed herein generally relates to enhancing and widening the spatial effects of stereo audio systems. Conventional systems seek to enhance the spatial effect of stereo audio by boosting the difference between the left and right signals. However, as noted above, such can be affected by external factors such as the auditory characteristics of the listeners, or the nature of the audio signals. For instance, while certain parameters might be preferable for some audiences, others audiences may feel that the sound is biased along certain direction. Accordingly, unlike conventional systems, an object of some features disclosed herein is not necessarily to attempt to provide a faithful reconstruction on the stereo audio signals, but rather to improve the auditory pleasure of the audiences.

Thus, in order to, e.g., enhance the spatial effects of a stereo audio system, and/or to conceal the adverse effects that can be caused by the external factors, one object of the disclosed subject matter is to integrate, on top of the traditional enhancement methods (e.g., boosting the difference between the left and right signals), a continuous transformation of the sound field. By integrating a continuous transformation of the sound field, audiences typically receive a stronger impression on the localization of different sound sources in the audio signal.

Moreover, various enhancements to the spatial effect of audio output can be achieved for both widely and closely spaced loudspeakers. Sound field transformations mechanism, such as those disclosed herein, can result in the impression that the sound sources in the audio signal are moved around the audiences, hence avoiding the problem of being perceived as originated from a narrow aperture in space. In addition, the features disclosed herein can also enhance the stereo perception on stereo audio signals that only have small (or no) difference between the left and right channels, which creates difficulties for conventional systems or methods.

In general, the disclosed audio spatial enhancements can be constituted by various mechanisms, namely, a static mechanism, a patterned mechanism, and a random mechanism. Briefly, the static component can be constituted by the aforementioned boosting of the ambience signals through mixing of the left and right channels. The patterned mechanism component can shift the spatial positions of the ambience signals along a periodic trajectory, simulating the regular movement of elements in a listening environment. This periodic trajectory may be in the form of horizontal or vertical displacement, or a combination of both horizontal and vertical displacement. The random mechanism can impose a random disturbance to the patterned mechanism, thereby simulating the irregular movement of elements in the listening environment.

As used in this application, the terms "component," "module," "system," or the like can, but need not, refer to a computer-related entity, either hardware, a combination of hardware and software, software, or software in execution. For example, a component might be, but is not limited to be, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the various embodiments may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. For example, computer readable media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick, key drive . . . ). Additionally it should be appreciated that a carrier wave can be employed to carry computer-readable electronic data such as those used in transmitting and receiving electronic mail or in accessing a network such as the Internet or a local area network (LAN). Of course, those skilled in the art will recognize many modifications may be made to this configuration without departing from the scope or spirit of the claimed subject matter.

Moreover, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or." Therefore, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Referring now to the drawings, with reference initially to FIG. 1, computer-implemented system 100 that can enhance audio spatial effects is depicted. Generally, system 100 can include receiving component 102 that can be configured to receive summation signal 104 and/or ambience signal 106. It should be understood that summation signal 104 and/or ambience signal 106 can be obtained from or derived from a source stereo signal, depicted here as reference numeral 108. Typically, source stereo signal 108 will include at least a left (L) channel and a right (R) channel, denoted here as reference numerals 110 and 112, respectively. The signals comprising these channels 110 and 112 can be employed to construct summation signal 104 and ambience signal 106.

For example, summation signal 104 can be constructed as a sum of left signal 110 and right signal 112 (e.g., L+R). In contrast, ambience signal 106 can be constructed as a difference between left signal 110 and right signal 112 (e.g., L−R). Regardless of the means, as noted supra, receiving component 102 can receive the resultant summation signal 104 and/or ambience signal 106. It should be appreciated that the structure provided herein with respect to left and right channels or signals or speakers is intended to provide a concrete, readily understood example. However, it should be understood that such denotations can be selected arbitrarily and a specific signal or transformation applied to any given left designation might just as easily be applied to the corresponding right designation instead, and vice versa. Accordingly, ambience signal 106, in certain cases, or based upon a different definition scheme, can be constructed as the difference between the right signal 112 and the left signal 110 (e.g., R−L) without necessarily departing from the scope of this disclosure or the appended claims.

In addition, system 100 can also include audio enhancement component 114 that can be configured to construct enhanced output signal 116. Enhanced output signal 116 can include at least one left output signal and at least one right output signal. Moreover, enhanced output signal 116 can be based upon at least one modulation, with a time-dependent function, of summation signal 104 or the ambience signal 106, although, typically, enhanced output signal 116 will be based upon a modulation of ambience signal 106. Thus, while many conventional systems simply boost ambience signal 106 (or some signal constructed as the difference between the left and right channels) in order to create a spatial widening effect, such a technique, while quite successful in the industry, still suffers from the aforementioned issues. However, such issues can be mitigated by transforming ambience signal 106 according to a time-dependent function in order to generate enhanced output signal 116, and prior to outputting enhanced output signal 116 to, e.g., stereo speakers 118.

In more detail, consider a source is a stereo audio signal (e.g., stereo signal 108) comprising of a left (L(t)) and a right (R(t)) channels, where t denotes the time variable. The left channel L(t) can be decomposed with a M-bank filter into M channels given by:

$$L(t) \approx \sum_{i=0}^{M-1} L_i(t) \tag{1}$$

Similarly, the right channel R(t) can be decomposed with a M-bank filter into M channels given by:

$$R(t) \approx \sum_{i=0}^{M-1} R_i(t), \tag{2}$$

where M is a integer that is larger than or equal to unity, and $0 \le i < M$ denotes the index to each of the M pairs of channels.

Such decomposition of the stereo signals into M bands can, for example, enable various spatial enhancement schemes to be conducted in different bands of the stereo signals.

For each of the M pairs of channels, each pair consisting of a left channel $L_i(t)$ and a right channel $R_i(t)$, one or more of, inter alia, the nine signals $A_i(t)$, $B_i(t)$, $C_i(t)$, $D_i(t)$, $E_i(t)$, $F_i(t)$, $G_i(t)$, $H_i(t)$, and $I_i(t)$ can be generated by audio enhancement component 114. Examples of these nine signals are given by the following equations (3)-(11):

$$A_i(t)|_{0 \le i < M} = L_i(t) + R_i(t). \tag{3}$$

$$B_i(t)|_{0 \le i < M} = L_i(t) - R_i(t). \tag{4}$$

Where $A_i(t)$ can represent summation signal 104 and $B_i(t)$ can represent ambience signal 104. Hence, it should be appreciated that while audio enhancement component 114 can construct enhanced output signal 116 based upon one or both of signals 104 and 106, audio enhancement component 114 can also generate both summation signal 104 and ambience signal 106 from source stereo signal 108.

$$C_i(t)|_{0 \le i < M} = \alpha_i A_i(t) + \beta_i B_i(t)[1 + w_i f_i(t)], \tag{5}$$

$$D_i(t)|_{0 \le i < M} = \alpha_i A_i(t) - \beta_i B_i(t)[1 - w_i f_i(t)], \tag{6}$$

$$E_i(t)|_{0 \le i < M} = \alpha_i A_i(t) + \beta_i B_i(t)[1 + w_i f_i(t)], \tag{7}$$

$$F_i(t)|_{0 \le i < M} = \alpha_i A_i(t) - \beta_i B_i(t)[1 - w_i f_i(t)], \tag{8}$$

$$G_i(t)|_{0 \le i < M} = \alpha_i A_i(t), \tag{9}$$

$$H_i(t)|_{0 \le i < M} = \beta_i B_i(t)[1 + w_i f_i(t)], \tag{10}$$

$$I_i(t)|_{0 \le i < M} = -\beta_i B_i(t)[1 - w_i f_i(t)], \tag{11}$$

where $\alpha_i$, $\beta_i$ and $w_i$ can be real numbers within the dynamic range $[0,1]_i$, and each can either be a preset constant value, or manually adjusted by the listener. Moreover, it should be understood that the said dynamic range $[0,1]_i$ can be employed for the sake of simplifying the mathematical description. However, in practical implementation the ranges of $\alpha_i$, $\beta_i$ and $w_i$ can be scaled up or scaled down by a factor.

Furthermore, $f_i(t)$ is a semi-periodic signal which can be described as:

$$f_i(t) = f_i(t + T + \Delta T), \tag{12}$$

where T can be the fundamental period and ΔT can be a random value with a particular probability density function.

Typically, the value of T should be large relative to the frequency of the audio signals to avoid fast shifting of the sound sources, a phenomena that does not normally happen in the real world. Also, the value of ΔT should usually be selected to be small relative to T in order to provide a mild chaotic disturbance on the periodic movement of the ambience signals. In one or more aspect, T is larger than 2 seconds and the dynamic range of ΔT can be $$\left[0, \frac{T}{10}\right].$$

However, it is understood that each of these two quantities can either be a preset constant value, or manually adjusted by the audience according to personal preference.

Thus, whether previously generated elsewhere and received or generated from source stereo signal 108 by audio enhancement component 114, numerous additional signals can be constructed from summation signal 104 and/or ambience signal 106. These numerous additional signals are further detailed in connection with FIG. 2, and are, either individually, collectively or a portion thereof, or in combination with one another, considered to represent enhanced output signal 116.

Figure 2:
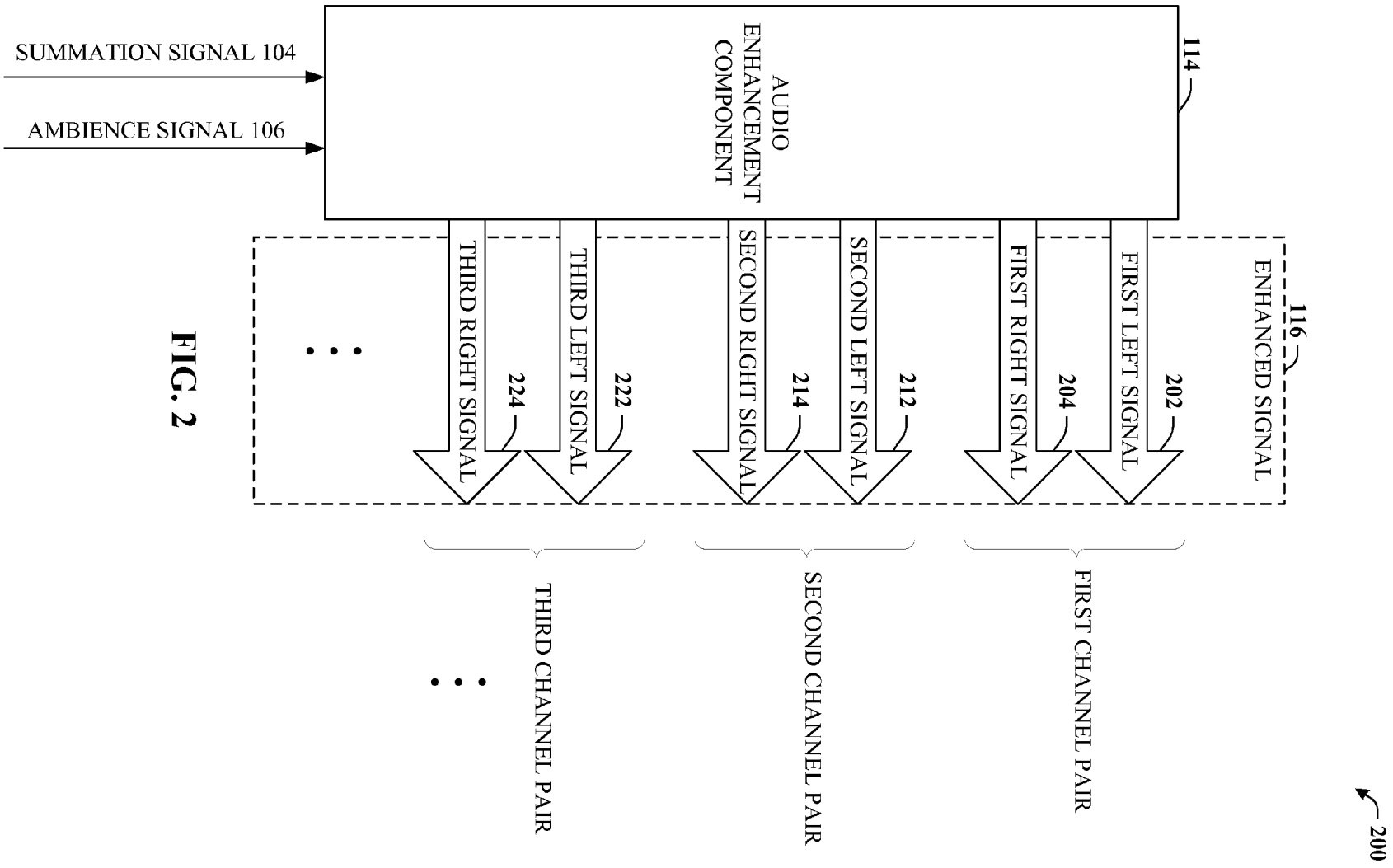
FIG. 2 depicts a block diagram of a system that can provide an enhanced output signal in discrete channel pairs, each including a left channel and a right channel.

Turning now to FIG. 2, system 200 that can provide an enhanced output signal in discrete channel pairs, each including a left channel and a right channel is illustrated. In general, system 200 can include audio enhancement component 114 as well as some means for receiving (e.g., when not created from the source signal) summation signal 104 and ambience signal 106, such as receiving component 102.

As detailed previously, audio enhancement component 114 can be configured to construct enhanced output signal 116, which can include at least one left output signal (e.g., first left output signal 202, second left output signal 212, third left output signal 222 . . . ) and at least one right output signal (e.g., first right output signal 204, second right output signal 214, third right output signal 224 . . . ), which, as discussed can be produced in left-right channel pairs. In one or more aspects, the at least one left output signal can be constructed by audio enhancement component 114 as an additive combination of summation signal 104 and ambience signal 106. In particular, this additive combination can be constructed as a sum of summation signal 104 and ambience signal 106, one or both of which is attenuated by at least one predetermined value (e.g., $\alpha_i$ or $\beta_i$) and one or both of which is multiplied by at least one time-dependent function (e.g., $1+w_i f_i(t)$). An example of the above can be $C_i(t)$ found at equation (5). Thus, first left output signal 202 can be generated or represented by, e.g.:

$$\hat{L}(t) = \sum_{i=0}^{M-1} C_i(t). \tag{13}$$

Similarly, in one or more aspects, the at least one right output signal can be constructed by audio enhancement component 114 as subtractive combination of summation signal 104 and ambience signal 106. In particular, this subtractive combination can be constructed as a difference between summation signal 104 and ambience signal 106, one or both of which is attenuated by at least one predetermined value (e.g., $\alpha_i$ or $\beta_i$) and one or both of which is multiplied by a negation of the at least one time-dependent function (e.g., $1-w_i f_i(t)$). An example of the right output signal can be $D_i(t)$ found at equation (6). Therefore, first right output signal 204 can be constructed or represented as, e.g.:

$$\hat{R}(t) = \sum_{i=0}^{M-1} D_i(t). \tag{14}$$

It should be underscored that one or more of the at least one predetermined value (e.g., various coefficients, weighting factors, and/or attenuation values for summation signal 104, ambience signal 106, and/or the time-dependent function) or a fundamental period for the at least one time-dependent function can be dynamically configurable in real time, for instance by audio enhancement component 114, or another component, based upon, e.g., a type or characteristic of source stereo signal 108 or based upon an input or due to a preference of a listener or the like. In addition, one or more of the at least one predetermined value or a fundamental period for the at least one time-dependent function can be equivalent for both the left output signal and the right output signal. In other words, these values can be identical for individual channel pairs or identical across all output that constitutes enhanced output signal 116.

In one or more aspects, second left output signal 212 can be constructed as an additive combination of left source signal 110 and a function of ambience signal 106 multiplied by the time-dependent function. Such can be exemplified by $E_i(t)$ found at equation (7). Hence, audio enhancement component 114 can generate second left output signal 212 by employing, e.g.:

$$\hat{L}(t) = \sum_{i=0}^{M-1} E_i(t). \tag{15}$$

Likewise, second right output signal 214 can be constructed as subtractive combination of right source signal 112 and a function of ambience signal 106 multiplied by a negation of the time-dependent function. Such can be exemplified by $F_i$ (t) found at equation (8), such that audio enhancement component 114 can employ the following equation in order to construct all or a portion of second right output signal 214:

$$\hat{R}(t) = \sum_{i=0}^{M-1} F_i(t) \tag{16}$$

Furthermore, in one or more aspects, third left output signal 222 can be constructed as a function of ambience signal 106 multiplied by the time-dependent function. Likewise, third right output signal 224 can be constructed as a negative function of ambience signal 106 multiplied by a negation of the time-dependent function, which can be found, respectively, at equations (10) and (11). Hence, audio enhancement component 114 can generate third left output signal 222 and third right output signal 224 by respectively employing, e.g.:

$$\hat{L}(t) = \sum_{i=0}^{M-1} H_i(t) \text{ and} \tag{17}$$

$$\hat{R}(t) = \sum_{i=0}^{M-1} I_i(t). \tag{18}$$

It should be understood that while audio enhancement component 114 is depicted with the capability to construct three channel pairs, additional signals are possible as well. As such, the six disclosed signals for the three channel pairs is not necessarily intended to limit the capability of audio enhancement component 114. Moreover, what has been described above generally pertains to systems equipped for dual, left-right channel pairs, however, it should be understood that signals intended for middle or center speakers can be generated as well, which, along with other features, is further discussed with reference to FIG. 3.

Figure 3:
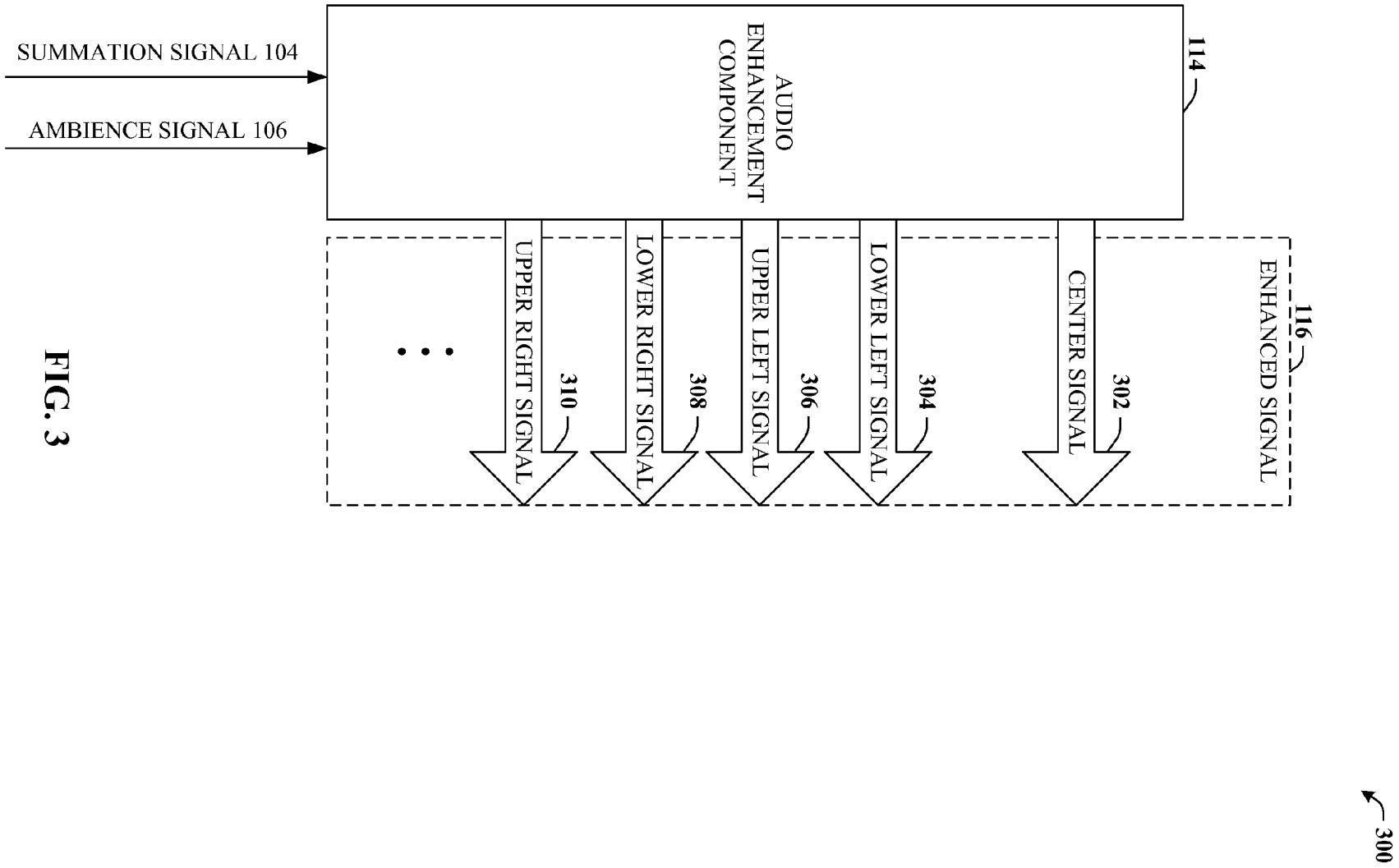
FIG. 3 provides block diagram of a system that can provide additional aspects or features in connection with an enhanced output signal.

Referring now to FIG. 3, system 300 that can provide additional aspects or features in connection with an enhanced output signal is depicted. As was the case in previous figures, system 300 can include audio enhancement component 114 for generating one or more enhanced output signal 116 by way of a modulation of ambience signal 106 with a time-dependent function. Furthermore, in order to account for systems configured with a middle speaker, audio enhancement component 114 can also construct enhanced output signal 116 to include center signal 302, which can be generated as a function of summation signal 104, such as that illustrated by $G_i(t)$ of equation (9). Therefore, audio enhancement component 114 can construct center signal 302 based upon:

$$\hat{G}(t) = \sum_{i=0}^{M-1} G_i(t). \tag{19}$$

Center signal 302 will typically be utilized in conjunction with third left signal 222 and third right signal 224. However, it should be understood that such need not always be the case. For example, center signal 302 can be utilized with either the first channel pair (e.g., signals 202 and 204) or the second channel pair (e.g., signals 212 and 214) of FIG. 2, as well as those later detailed here in FIG. 3. Moreover, in addition to systems configured for center speaker output, audio enhancement component 114 can also provide signals for other speaker topologies, such as those with upper and lower left and right speakers. In particular, enhanced output signal 116 can further include at least one of a first lower left output signal (e.g., lower left signal 304) or a first upper left output signal (e.g., upper left signal 306). Such signals can be constructed based upon a slow-varying periodic function applied to an additive combination of a function of the summation signal and a function of the ambience signal multiplied by the time-dependent function. In essence, the lower and upper left channels can be generated in a manner similar to that for first left channel 202 of FIG. 2, but with the addition of a slow-varying periodic function, e.g., one of $p_0(t)$, $p_1(t)$, $p_2(t)$, and $p_3(t)$. In a more formal sense, lower (e.g., 304) and upper (e.g., 306) left signals can be constructed by audio enhancement component 114 by employing, respectively, e.g.:

$$\hat{L}_L(t) = (1 + p_0(t)) \sum_{i=0}^{M-1} C_i(t) \text{ and} \tag{20}$$

$$\hat{L}_U(t) = (1 + p_1(t)) \sum_{i=0}^{M-1} C_i(t). \tag{21}$$

For the corresponding right channel, enhanced output signal 116 can further include at least one of a first lower right output signal (e.g., lower right signal 308) or a first upper right output signal (e.g., upper right signal 310). These signals can be constructed based upon the same or a different slow-varying periodic function applied to subtractive combination of a function of the summation signal and a function of the ambience signal multiplied by a negation of the time-dependent function. Thus, the lower and upper right channels can be generated in a manner similar to that for first right channel 204 of FIG. 2, but again with the addition of the slow-varying periodic function. Thus, in order to construct lower and upper right signals 308 and 310, audio enhancement component 114 can employ, respectively, e.g.:

$$\hat{R}_L(t) = (1 + p_2(t)) \sum_{i=0}^{M-1} D_i(t) \text{ and} \tag{22}$$

$$\hat{R}_U(t) = (1 + p_3(t)) \sum_{i=0}^{M-1} D_i(t). \tag{23}$$

According to another embodiment, whereas the above upper and lower signals were generated in a manner similar to that of the first channel pair of FIG. 2, the upper and lower signals can also be generated according to the second channel pair of FIG. 2. For example, enhanced output signal 116 can further include at least one of a second lower left output signal (e.g., lower left signal 304) or a second upper left output signal (e.g., upper left signal 306). However, in this case, these signals can be constructed based upon a slow-varying periodic function applied to an additive combination of left source signal 108 and a function of ambience signal 106 multiplied by the time-dependent function. Hence, the lower left signals can be constructed by audio enhancement component 114 by employing, e.g.:

$$\hat{L}_L(t) = (1 + p_0(t)) \sum_{i=0}^{M-1} E_i(t). \tag{24}$$

Likewise, audio enhancement component 114 can construct the upper left signal $\hat{L}_U(t)$ as:

$$\hat{L}_U(t) = (1 + p_1(t)) \sum_{i=0}^{M-1} E_i(t). \tag{25}$$

For the corresponding right channel, enhanced output signal 116 can further include at least one of a second lower right output signal (e.g., lower right signal 308) or a second upper right output signal (e.g., upper right signal 310). These signals can be constructed based upon the same or a different slow-varying periodic function applied to subtractive combination of right source signal 112 and a function of the ambience signal multiplied by a negation of the time-dependent function. For this case, in order to construct lower and upper right signals 308 and 310, audio enhancement component 114 can employ, respectively, e.g.:

$$\hat{R}_L(t) = (1 + p_2(t)) \sum_{i=0}^{M-1} F_i(t) \text{ and} \tag{26}$$

-continued $$\hat{R}_U(t) = (1 + p_3(t))\sum_{i=0}^{M-1} F_i(t). \tag{27}$$

In still another embodiment, the lower left (e.g., 304), upper left (e.g., 306), lower right (e.g., 308) and upper right (e.g., 310) signals can be generated according to a third means, for example, in a manner similar to that for the third channel pair of FIG. 2. In this case, enhanced output signal 116 can further include at least one of a third lower left output signal or a third upper left output signal. Such signals can again be constructed based upon a slow-varying periodic function applied to a function of the ambience signal multiplied by the time-dependent function. Thus, audio enhancement component 114 can construct lower (e.g., 304) and upper (e.g., 306) left signals by employing, respectively, e.g.:

$$\hat{L}_L(t) = (1 + p_0(t))\sum_{i=0}^{M-1} H_i(t) \text{ and} \tag{28}$$

$$\hat{L}_U(t) = (1 + p_1(t))\sum_{i=0}^{M-1} H_i(t). \tag{29}$$

For the corresponding right channel, enhanced output signal 116 can further include at least one of a third lower right output signal (e.g., lower right signal 308) or a third upper right output signal (e.g., upper right signal 310). In this case, these signals can be constructed based upon the same or a different slow-varying periodic function applied to a negative function of the ambience signal multiplied by a negation of the time-dependent function. Thus, the lower and upper right channels can be generated in a manner similar to that for third right channel 224 of FIG. 2, but again with the addition of the slow-varying periodic function. Thus, in order to construct lower and upper right signals 308 and 310, audio enhancement component 114 can employ, respectively, e.g.:

$$\hat{R}_L(t) = (1 + p_2(t))\sum_{i=0}^{M-1} I_i(t) \tag{30}$$

$$\hat{R}_U(t) = (1 + p_3(t))\sum_{i=0}^{M-1} I_i(t). \tag{31}$$

Moreover, again a center signal can be generated as before, by employing equation (19), which was provided as:

$$\hat{G}(t) = \sum_{i=0}^{M-1} G_i(t). \tag{19}$$

As introduced above, each M channel pairs can be processed according to identical parameters. For example:

$$\alpha_i|_{0\le i<M} = \alpha \tag{32}$$

$$\beta_i|_{0\le i<M} = \beta \tag{33}$$

$$w_i|_{0\le i<M} = w \tag{34}$$

$$f_i(t)|_{0\le i<M} = f(t) \tag{35}$$

$$\omega_{c;i}|_{0\le i<M} = \omega_c \tag{36}$$

It should be appreciated that in certain aspects, the at least one time-dependent function can be characterized by a sinusoidal wave. Hence, in accordance with the above, $f_i(t)$ is a sinusoidal wave in this case. Furthermore, in at least one aspect, the slow-varying periodic functions, $p_0(t)$, $p_1(t)$, $p_2(t)$, and $p_3(t)$ can be characterized by a slow-varying sinusoidal wave. Moreover, in one or more aspects all slow-varying functions can be equivalent, and may be different in polarity, such that $p_0(t)=p_2(t)=p(t)$, and $p_1(t)=p_3(t)=-p(t)$, and where p(t) can be a slow-varying sinusoidal wave.

Figure 4:
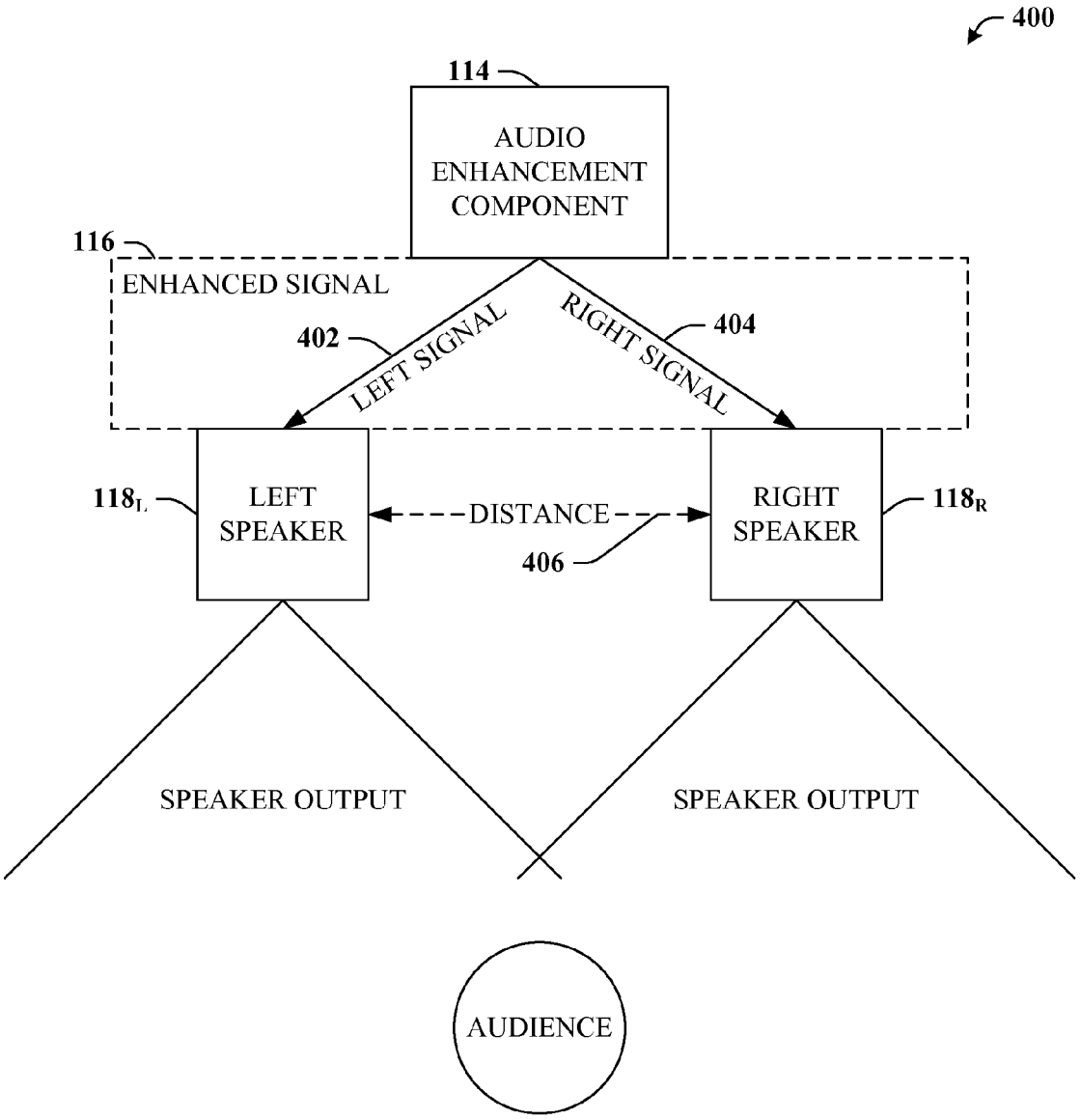
FIG. 4 depicts a block diagram of a graphic depiction illustrates a first example speaker topology for receiving the enhanced signal provided in orthographic, or top-down, view.

Turning now to FIG. 4, graphic depiction 400 illustrates a first example speaker topology for receiving the enhanced signal in orthographic, or top-down, view. In this, the simplest case, enhanced output signal 116 generated by audio enhancement component 114 can be provided to left speaker $\mathbf{118}_L$ and right speaker $\mathbf{118}_R$, which can be consumed as speaker output by the audience positioned in the environment. As noted supra, the distance between the speakers, here denoted as distance 406, can cause issues with conventional enhancement schemes. Moreover, given that distance 406 is often controlled by an outside agent (e.g., the owner of the speakers), such issues cannot be addressed by conventional enhancement schemes.

In this case, audio enhancement component 114 can provide left signal 402 to left speaker $\mathbf{118}_L$ and right signal 404 to right speaker $\mathbf{118}_R$. Left signal 402 and right signal 404 can correspond to any of the previously mentioned channel pairs, such as the first, second, or third channel pairs of FIG. 2, but will typically be one of either the first channel pair or the second channel pair.

Figure 5:
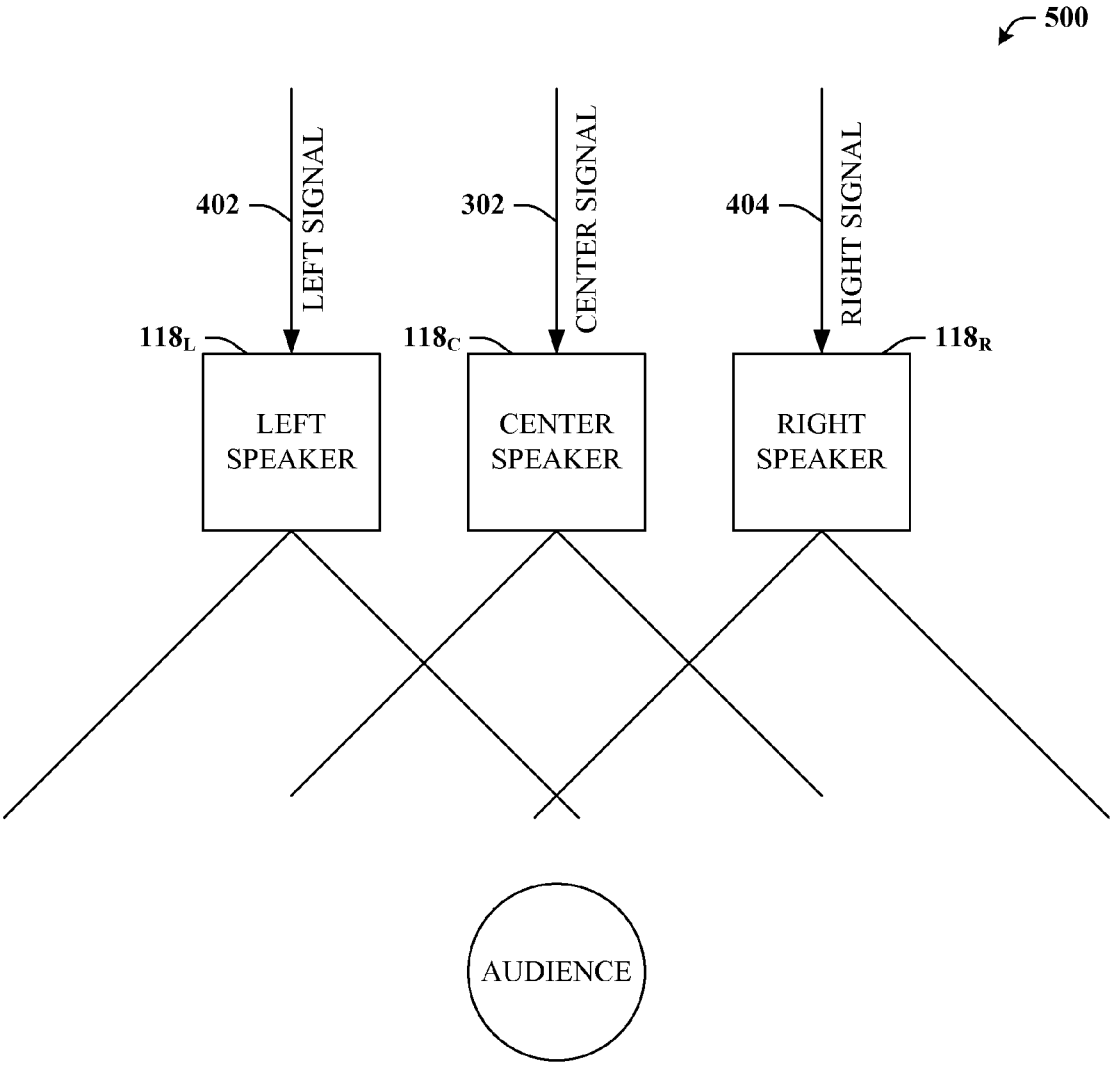
FIG. 5 provides block diagram of a graphic depiction illustrating a second example speaker topology for receiving the enhanced signal provided in orthographic, or top-down, view.

FIG. 5 provides graphic depiction 500 illustrating a second example speaker topology for receiving the enhanced signal in orthographic, or top-down, view. In this second example, enhanced output signal 116 (e.g., signals 302, 402, and 404, collectively) generated by audio enhancement component 114 (not shown) can be provided to left speaker $\mathbf{118}_L$, right speaker $\mathbf{118}_R$, and center speaker $\mathbf{118}_C$, which can be consumed as speaker output by the audience positioned in the environment. Specifically, audio enhancement component 114 can provide left signal 402 to left speaker $\mathbf{118}_L$, center signal 302 (detailed in connection with FIG. 3) and right signal 404 to right speaker $\mathbf{118}_R$. Again, left signal 402 and right signal 404 can correspond to any of the previously mentioned channel pairs, such as the first, second, or third channel pairs of FIG. 2, but will typically be the third channel pair.

Figure 6A:
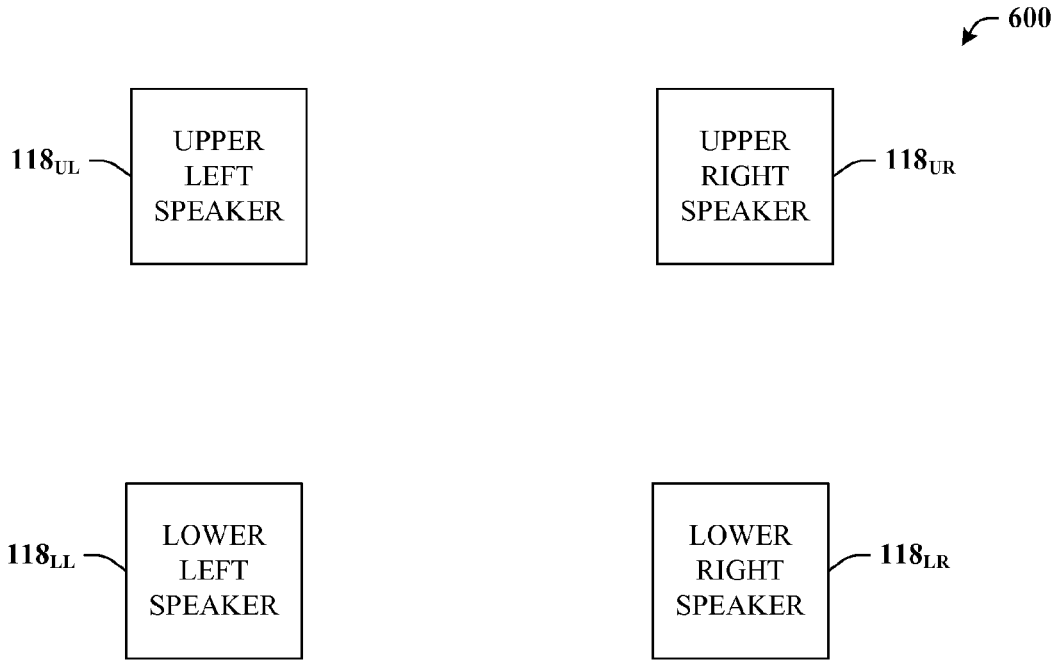
FIG. 6A depicts a block diagram of a graphic depiction illustrating a third example speaker topology for receiving the enhanced signal provided in first-person view.

Referring now to FIG. 6A, graphic depiction 600 illustrating a third example speaker topology for receiving the enhanced signal is provided in first-person view. In this third example, enhanced output signal 116 will typically be provided by audio enhancement component 114 in accordance with a slow-varying periodic function, and hence correspond to signals detailed in connection with FIG. 3 (e.g., signals 304-310). Each speaker, $\mathbf{118}_{UL}$, $\mathbf{118}_{UR}$, $\mathbf{118}_{LL}$, and $\mathbf{118}_{LR}$ can be arranged as illustrated or similarly and can receive the corresponding signal from audio enhancement component 114. As with FIG. 4, the signals received by the depicted speakers will typically be based upon the equations (5)-(8) (e.g., detailed with reference to the first and second channel pairs of FIG. 2).

Figure 6B:
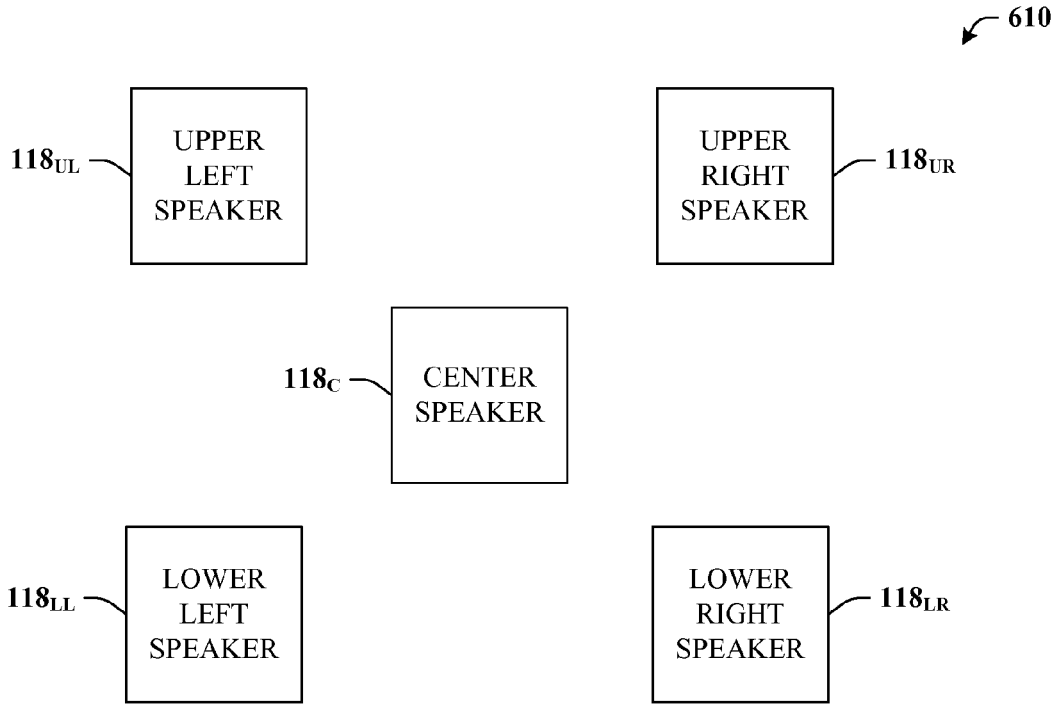
FIG. 6B illustrates a block diagram of a graphic depiction illustrating a fourth example speaker topology for receiving the enhanced signal provided in first-person view.

Likewise, with reference now to FIG. 6B, graphic depiction 610 illustrating a fourth example speaker topology for receiving the enhanced signal is provided in first-person view. In this fourth example, enhanced output signal 116 will typically be provided by audio enhancement component 114 in accordance with a slow-varying periodic function, and hence correspond to signals detailed in connection with FIG. 3 (e.g., signals 304-310). Each speaker, $\mathbf{118}_{UL}$, $\mathbf{118}_{UR}$, $\mathbf{118}_{C}$, $\mathbf{118}_{LL}$, and $\mathbf{118}_{LR}$ can be arranged as illustrated or in a similar manner and can receive the appropriate signal from audio enhancement component 114. As with FIG. 5, the signals received by the depicted speakers will typically be based upon the equations (10) and (11) (e.g., detailed with reference to the third channel pair of FIG. 2).

FIGS. 7-10 illustrate various methodologies in accordance with one or more embodiments described herein. While, for purposes of simplicity of explanation, the methodologies are shown and described as a series of acts, it is to be understood and appreciated that the embodiments are not limited by the order of acts, as some acts may occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the various embodiments. Additionally, it should be further appreciated that the methodologies disclosed hereinafter and throughout this specification are capable of being stored on an article of manufacture to facilitate transporting and transferring such methodologies to computers. The term article of manufacture, as used herein, is intended to encompass a computer program accessible from any computer-readable device, carrier, or media.

Figure 7:
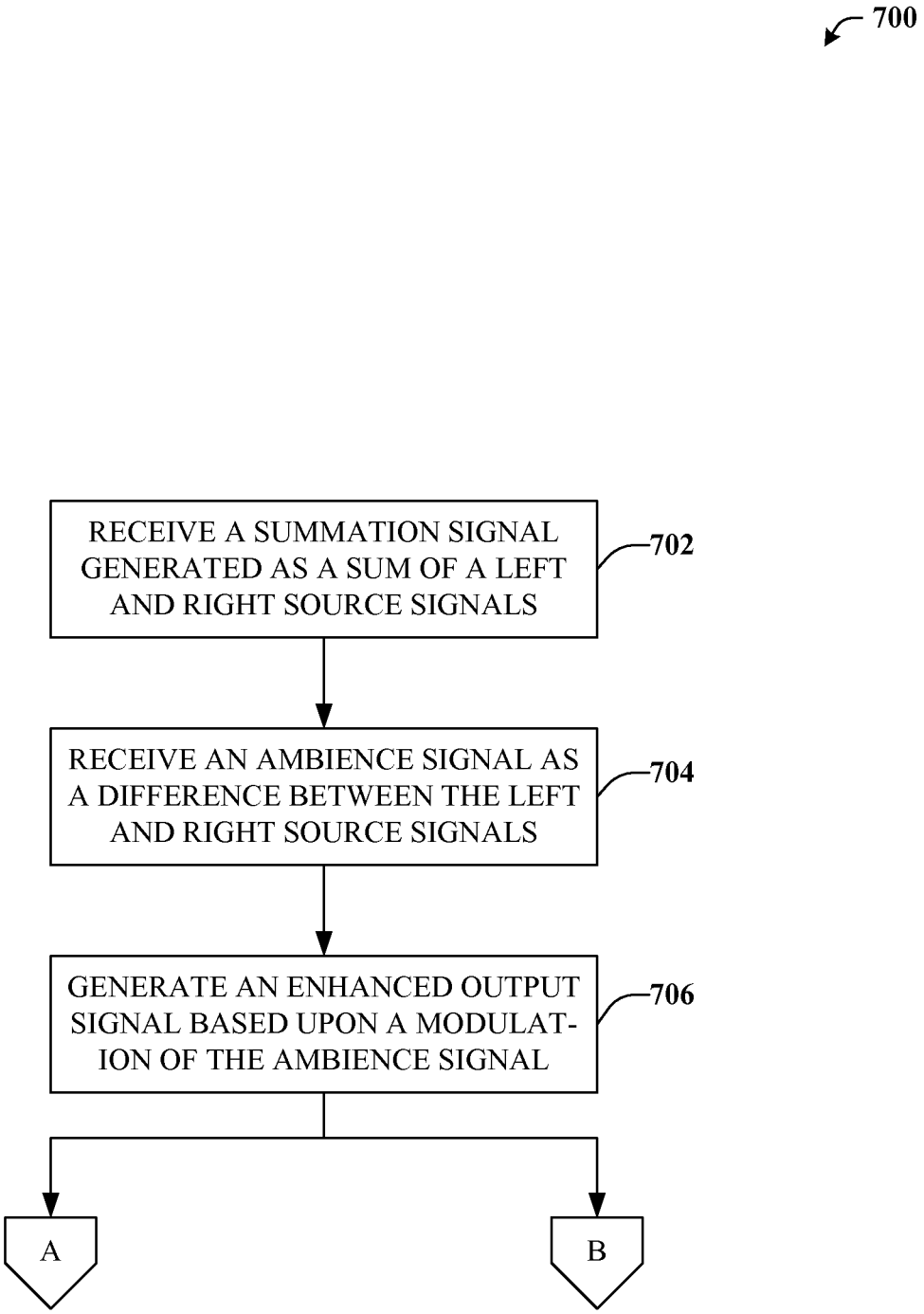
FIG. 7 is an exemplary flow chart of procedures that define a method for enhancing audio spatial effects.

With reference now to FIG. 7, exemplary computer implemented method 700 for enhancing audio spatial effects is provided. Generally, at reference numeral 702, a summation signal generated as a sum of a left source signal and a right source signal can be received. In addition, at reference numeral 704, an ambience signal generated as a difference between the left source signal and the right source signal can be received.

Based upon these two signals, the summation signal and the ambience signal, at reference numeral 706, an enhanced output signal can be electronically generated. The enhanced output signal can include at least one channel pair comprising a left output signal and a right output signal, and can be based upon at least one modulation of the ambience signal with a time-varying function. In other words, the ambience signal, that which conventional systems utilize to widen the spatial effects of audio, can be transformed in accordance with the time-varying function, which can lead to a more pleasurable listening experience as well as mitigate various shortcomings with conventional schemes.

Figure 8:
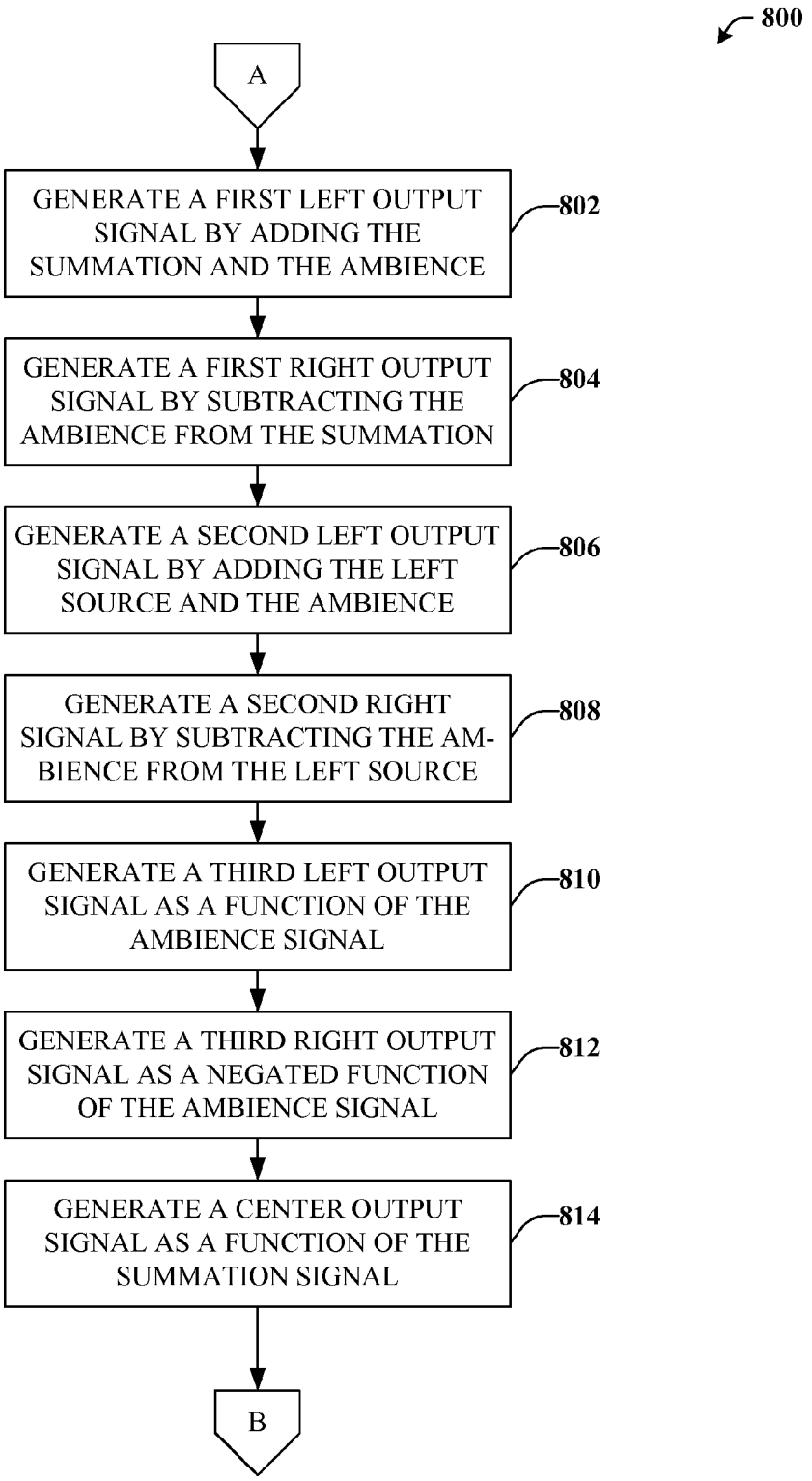
FIG. 8 depicts an exemplary flow chart of procedures that define a method for generating signals for channel pairs or otherwise in connection with enhancing audio spatial effects.

Referring to FIG. 8, exemplary computer implemented method 800 for generating signals for channel pairs or otherwise in connection with enhancing audio spatial effects is depicted. At reference numeral 802, a first left output signal can be generated by additively combining a function of the summation signal and a function of the ambience signal multiplying by the time-varying function. In one or more aspect, such can be achieved by employing equation (5) detailed supra. Next, at reference numeral 804, a first right output signal can be generated by subtracting a function of the ambience signal from a function of the summation signal and multiplying by a negation of the time-varying function. In one or more aspects, such can be achieved by utilizing equation (6) disclosed above.

Additionally, at reference numeral 806, a second left output signal can be generated by additively combining a function of the left source signal and a function of the ambience signal multiplying by the time-varying function, which can be exemplified by equation (7) or, as with all equations detailed herein, by a similar context or variant thereof. Likewise, at reference numeral 808, a second right output signal can be generated by subtracting a function of the ambience signal from a function of the right source signal and multiplying by a negation of the time-varying function. In this latter case, equation (8) provides a ready example of such.

Furthermore, at reference numeral 810, a third left output signal can be generated by multiplying a function of the ambience signal by the time-varying function, which is provided for, as one example, by equation (10). For the corresponding right channel, at reference numeral 812, a third right output signal can be generated by multiplying a function of the ambience signal by a negation of the time-varying function. Moreover, in addition to constructing left-right channel pairs, a third channel, typically a center channel, can be accommodated as well. For example, at reference numeral 814, a center output signal can be generated as a function of the summation signal, as illustrated by equation (9).

Figure 9:
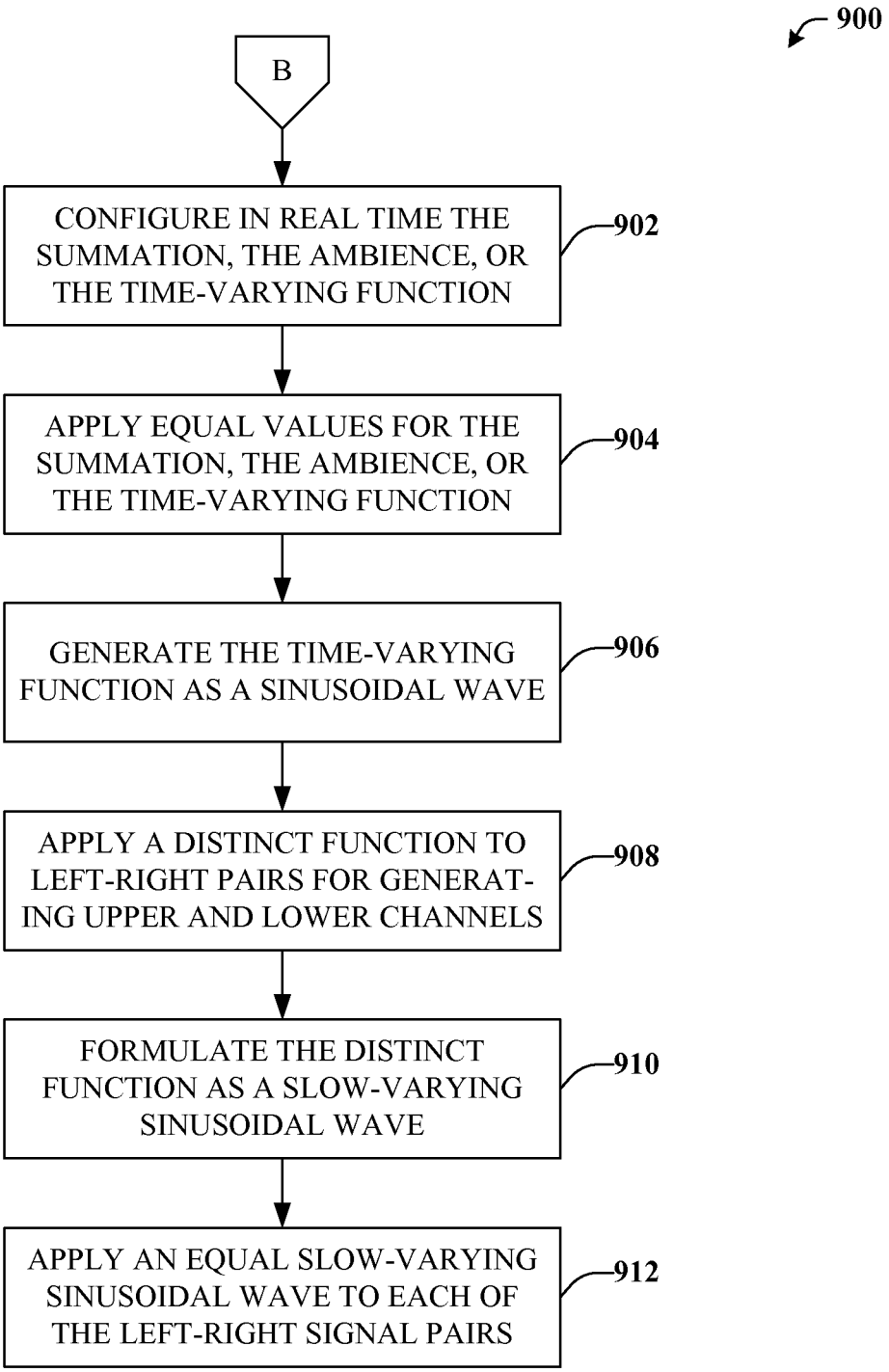
FIG. 9 illustrates an exemplary flow chart of procedures that define a method for providing additional features or aspects in connection with enhancing audio spatial effects.

With reference now to FIG. 9, method 900 for providing additional features or aspects in connection with enhancing audio spatial effects is illustrated. At reference numeral 902, at least one of the function of the summation signal (e.g., $\alpha_i A_i(t)$), the function of the ambience signal (e.g., $\beta_i B_i(t)$), or the time-varying function (e.g., $w_i f_i(t)$, or portions thereof) can be configured dynamically in real time. For example, certain parameters (e.g., $\alpha_i$, $\beta_i$ and $w_i$) can be dynamically configured based upon certain characteristics of the audio output or by a user or automatically in accordance with stored or inferred preferences of the user.

Moreover, at reference numeral 904, equivalent values for each left-right channel pair can be applied for at least one of the function of the summation signal, the function of the ambience signal, or the time-varying function. Hence, all such parameters can be identical, and can be so for not only channel pairs, but for all output signals. Next, at reference numeral 906, the time-varying function can be generated as a sinusoidal wave.

Furthermore, at reference numeral 908, at least one distinct function can be applied to one or more left-right output signal pairs for generating an upper and a lower channel for each signal pair. In a related portion, at reference numeral 910, the at least one distinct unction can be formulated as a slow-varying sinusoidal wave. Still further yet, at reference numeral 912, an equivalent slow-varying sinusoidal wave can be applied to each of the one or more left-right signal pairs.

Figure 10:
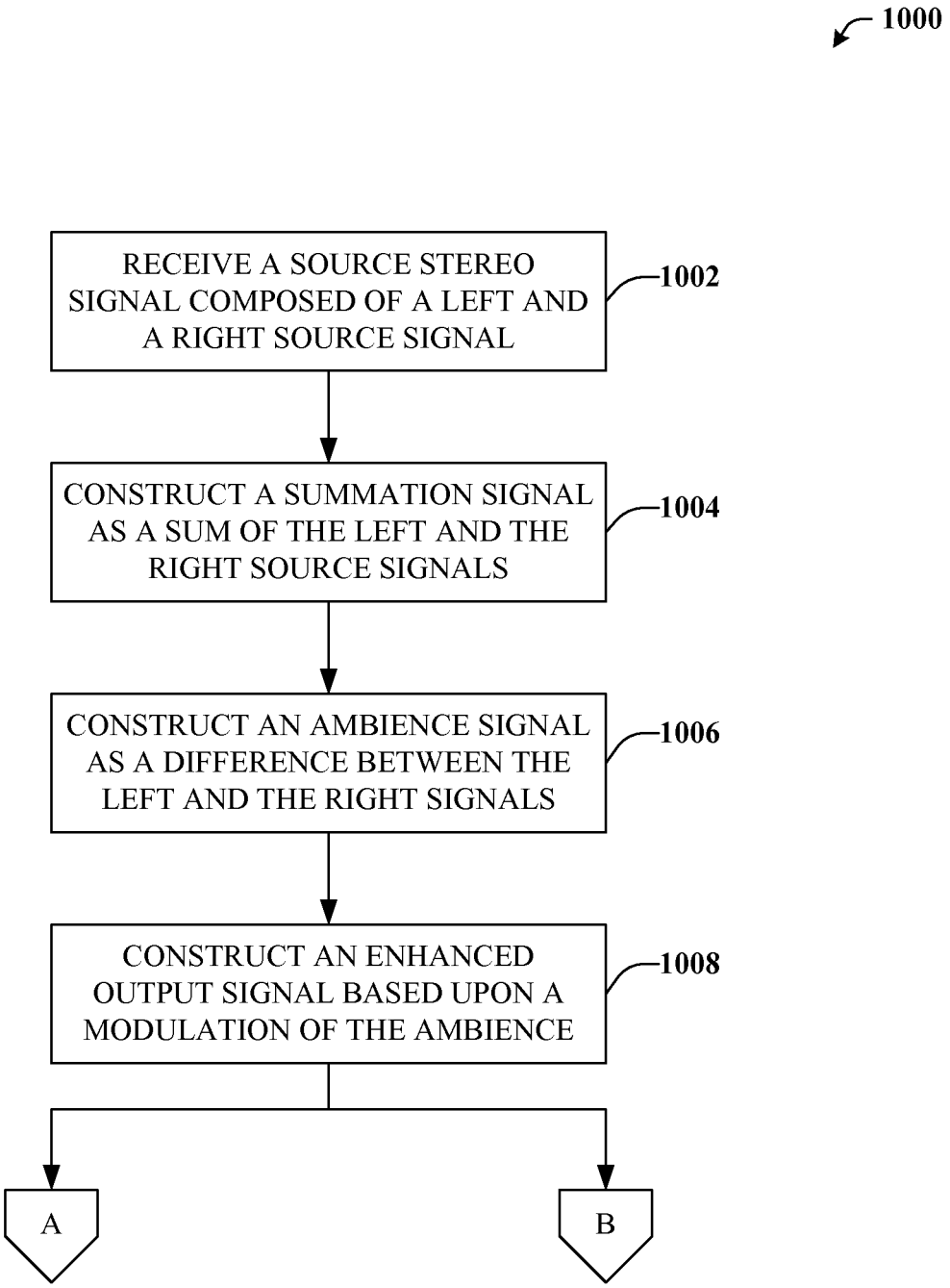
FIG. 10 depicts an exemplary flow chart of procedures defining a method for constructing base signals in connection with enhancing audio spatial effects.

With reference now to FIG. 10, exemplary computer implemented method 1000 for constructing base signals in connection with enhancing audio spatial effects is provided. Generally, at reference numeral 1002, a source stereo signal composed of a left source signal and a right source signal can be received. Accordingly, at reference numeral 1004, a summation signal can be constructed as a sum of the left source signal and the right source signal. In addition, at reference numeral 1006, an ambience signal can be constructed as a difference between the left source signal and the right source signal.

Equipped with these two base signals, the summation signal constructed at reference numeral 1004 and the ambience signal constructed at 1006, an enhanced output signal can be generated. In particular, at reference numeral 1008, an enhanced output signal including at least one channel pair comprising a left output signal and a right output signal can be electronically constructed based upon at least one modulation of the ambience signal with a time-varying function.

Figure 11:
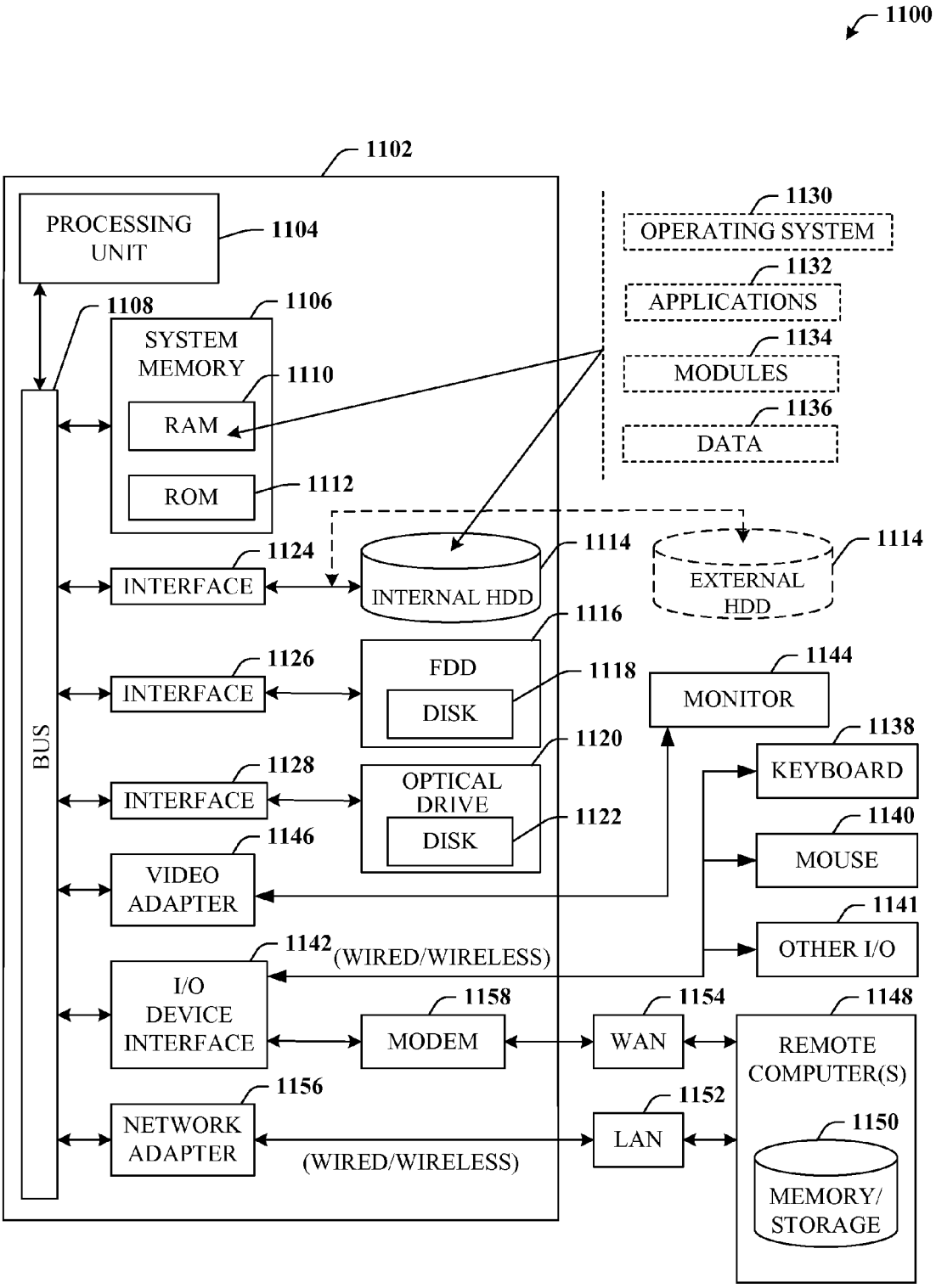
FIG. 11 illustrates a block diagram of a computer operable to execute or implement all or portions of the disclosed architecture.

Referring now to FIG. 11, there is illustrated a block diagram of an exemplary computer system operable to execute the disclosed architecture. In order to provide additional context for various aspects of embodiment(s) described herein, FIG. 11 and the following discussion are intended to provide a brief, general description of a suitable computing environment 1100 in which the various aspects of can be implemented. Additionally, while one or more embodiments described above may be suitable for application in the general context of computer-executable instructions that may run on one or more computers, those skilled in the art will recognize that such embodiments also can be implemented in combination with other program modules and/or as a combination of hardware and software.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects of the various embodiments may also be practiced in distributed computing environments where certain tasks are performed by remote processing devices that are linked through a communications network. In a distributed computing environment, program modules can be located in both local and remote memory storage devices.

A computer typically includes a variety of computer readable media. Computer readable media can be any available media that can be accessed by the computer and includes both volatile and nonvolatile media, removable and non-removable media. By way of example, and not limitation, computer-readable media can comprise computer storage media and communication media. Computer storage media can include volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

With reference again to FIG. 11, the exemplary environment 1100 for implementing various aspects includes a computer 1102, the computer 1102 including a processing unit 1104, a system memory 1106 and a system bus 1108. The system bus 1108 couples to system components including, but not limited to, the system memory 1106 to the processing unit 1104. The processing unit 1104 can be any of various commercially available processors. Dual microprocessors and other multi-processor architectures may also be employed as the processing unit 1104.

The system bus 1108 can be any of several types of bus structure that may further interconnect to a memory bus (with or without a memory controller), a peripheral bus, and a local bus using any of a variety of commercially available bus architectures. The system memory 1106 includes read-only memory (ROM) 1110 and random access memory (RAM) 1112. A basic input/output system (BIOS) is stored in a non-volatile memory 1110 such as ROM, EPROM, EEPROM, which BIOS contains the basic routines that help to transfer information between elements within the computer 1102, such as during start-up. The RAM 1112 can also include a high-speed RAM such as static RAM for caching data.

The computer 1102 further includes an internal hard disk drive (HDD) 1114 (e.g., EIDE, SATA), which internal hard disk drive 1114 may also be configured for external use in a suitable chassis (not shown), a magnetic floppy disk drive (FDD) 1116, (e.g., to read from or write to a removable diskette 1118) and an optical disk drive 1120, (e.g., reading a CD-ROM disk 1122 or, to read from or write to other high capacity optical media such as the DVD). The hard disk drive 1114, magnetic disk drive 1116 and optical disk drive 1120 can be connected to the system bus 1108 by a hard disk drive interface 1124, a magnetic disk drive interface 1126 and an optical drive interface 1128, respectively. The interface 1124 for external drive implementations includes at least one or both of Universal Serial Bus (USB) and IEEE1394 interface technologies. Other external drive connection technologies are within contemplation of the subject matter claimed herein.

The drives and their associated computer-readable media provide nonvolatile storage of data, data structures, computer-executable instructions, and so forth. For the computer 1102, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, may also be used in the exemplary operating environment, and further, that any such media may contain computer-executable instructions for performing the methods of the various embodiments.

A number of program modules can be stored in the drives and RAM 1112, including an operating system 1130, one or more application programs 1132, other program modules 1134 and program data 1136. All or portions of the operating system, applications, modules, and/or data can also be cached in the RAM 1112. It is appreciated that the various embodiments can be implemented with various commercially available operating systems or combinations of operating systems.

A user can enter commands and information into the computer 1102 through one or more wired/wireless input devices, e.g., a keyboard 1138 and a pointing device, such as a mouse 1140. Other input devices 1141 may include a speaker, a microphone, a camera or another imaging device, an IR remote control, a joystick, a game pad, a stylus pen, touch screen, or the like. These and other input devices are often connected to the processing unit 1104 through an input-output device interface 1142 that can be coupled to the system bus 1108, but can be connected by other interfaces, such as a parallel port, an IEEE1394 serial port, a game port, a USB port, an IR interface, etc.

A monitor 1144 or other type of display device is also connected to the system bus 1108 via an interface, such as a video adapter 1146. In addition to the monitor 1144, a computer typically includes other peripheral output devices (not shown), such as speakers, printers, etc.

The computer 1102 may operate in a networked environment using logical connections via wired and/or wireless communications to one or more remote computers, such as a remote computer(s) 1148. The remote computer(s) 1148 can be a workstation, a server computer, a router, a personal computer, a mobile device, portable computer, microprocessor-based entertainment appliance, a peer device or other common network node, and typically includes many or all of the elements described relative to the computer 1102, although, for purposes of brevity, only a memory/storage device 1150 is illustrated. The logical connections depicted include wired/wireless connectivity to a local area network (LAN) 1152 and/or larger networks, e.g., a wide area network (WAN) 1154. Such LAN and WAN networking environments are commonplace in offices and companies, and facilitate enterprise-wide computer networks, such as intranets, all of which may connect to a global communications network, e.g., the Internet.

When used in a LAN networking environment, the computer 1102 is connected to the local network 1152 through a wired and/or wireless communication network interface or adapter 1156. The adapter 1156 may facilitate wired or wireless communication to the LAN 1152, which may also include a wireless access point disposed thereon for communicating with the wireless adapter 1156.

When used in a WAN networking environment, the computer 1102 can include a modem 1158, or is connected to a communications server on the WAN 1154, or has other means for establishing communications over the WAN 1154, such as by way of the Internet. The modem 1158, which can be internal or external and a wired or wireless device, is connected to the system bus 1108 via the interface 1142. In a networked environment, program modules depicted relative to the computer 1102, or portions thereof, can be stored in the remote memory/storage device 1150. It will be appreciated that the network connections shown are exemplary and other means of establishing a communications link between the computers can be used.

The computer 1102 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least Wi-Fi and Bluetooth™ wireless technologies. Thus, the communication can be a predefined structure as with a conventional network or simply an ad hoc communication between at least two devices.

Wi-Fi, or Wireless Fidelity, allows connection to the Internet from a couch at home, a bed in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE802.11(a, b, g, etc.) to provide secure, reliable, fast wireless connectivity. A Wi-Fi network can be used to connect computers to each other, to the Internet, and to wired networks (which use IEEE802.3 or Ethernet). Wi-Fi networks operate in the unlicensed 2.4 and 5 GHz radio bands, at an 11 Mbps (802.11b) or 54 Mbps (802.11a) data rate, for example, or with products that contain both bands (dual band), so the networks can provide real-world performance similar to the basic "10BaseT" wired Ethernet networks used in many offices.

Figure 12:
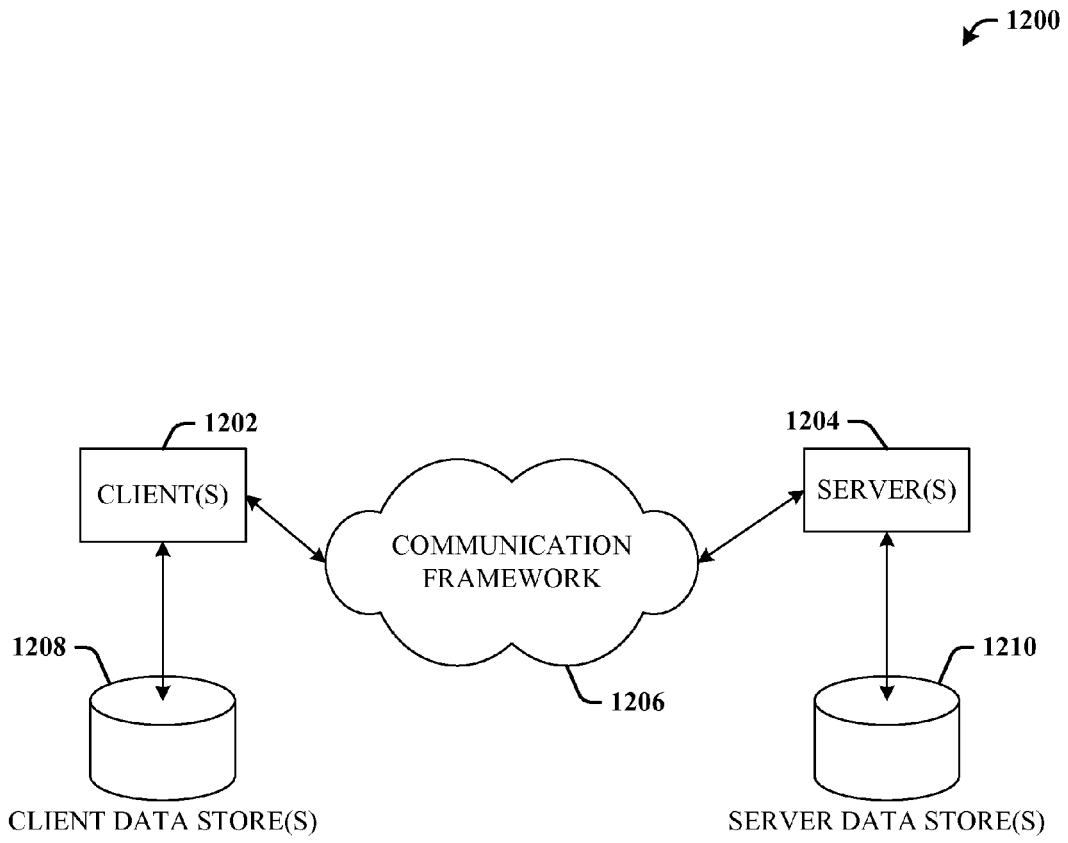
FIG. 12 illustrates a schematic block diagram of an exemplary computing environment.

Referring now to FIG. 12, there is illustrated a schematic block diagram of an exemplary computer compilation system operable to execute the disclosed architecture. The system 1200 includes one or more client(s) 1202. The client(s) 1202 can be hardware and/or software (e.g., threads, processes, computing devices). The client(s) 1202 can house cookie(s) and/or associated contextual information by employing one or more embodiments described herein, for example.

The system 1200 also includes one or more server(s) 1204. The server(s) 1204 can also be hardware and/or software (e.g., threads, processes, computing devices). The servers 1204 can house threads to perform transformations by employing one or more embodiments, for example. One possible communication between a client 1202 and a server 1204 can be in the form of a data packet adapted to be transmitted between two or more computer processes. The data packet may include a cookie and/or associated contextual information, for example. The system 1200 includes a communication framework 1206 (e.g., a global communication network such as the Internet) that can be employed to facilitate communications between the client(s) 1202 and the server(s) 1204.

Communications can be facilitated via a wired (including optical fiber) and/or wireless technology. The client(s) 1202 are operatively connected to one or more client data store(s) 1208 that can be employed to store information local to the client(s) 1202 (e.g., cookie(s) and/or associated contextual information). Similarly, the server(s) 1204 are operatively connected to one or more server data store(s) 1210 that can be employed to store information local to the servers 1204.

What has been described above includes examples of the various embodiments. It is, of course, not possible to describe every conceivable combination of components or methodologies for purposes of describing the embodiments, but one of ordinary skill in the art may recognize that many further combinations and permutations are possible. Accordingly, the detailed description is intended to embrace all such alterations, modifications, and variations that fall within the spirit and scope of the appended claims.

In particular and in regard to the various functions performed by the above described components, devices, circuits, systems and the like, the terms (including a reference to a "means") used to describe such components are intended to correspond, unless otherwise indicated or clear from context, to any component which performs the specified function of the described component (e.g., a functional equivalent), even though not structurally equivalent to the disclosed structure, which performs the function in the herein illustrated exemplary aspects of the embodiments. In this regard, it will also be recognized that the embodiments includes a system as well as a computer-readable medium having computer-executable instructions for performing the acts and/or events of the various methods.

In addition, while a particular feature may have been disclosed with respect to only one of several implementations, such feature may be combined with one or more other features of the other implementations as may be desired and advantageous for any given or particular application. Furthermore, to the extent that the terms "includes," and "including" and variants thereof are used in either the detailed description or the claims, these terms are intended to be inclusive in a manner similar to the term "comprising."

What is claimed is:

1. A system, comprising:

a processing device, coupled to a memory, that executes or facilitates execution of executable components, comprising:

a receiving component that receives a source stereo signal comprising a left channel signal and a right channel signal;

a spatial widening component that transforms the source stereo signal to a widened signal representing the source stereo signal with a spatial widening effect, wherein the widened signal comprises a summation signal and an ambience signal, and wherein the summation signal is constructed as a sum of the left channel signal and the right channel signal and wherein the ambience signal is constructed as a difference between the left channel signal and the right channel signal; and an audio enhancement component that transforms the widened signal to an enhanced output signal representing the widened signal with an audio element that conceals a non-uniform spatial element of the widened signal and comprises at least one left output signal and at least one right output signal, wherein the audio enhancement component generates the audio element based on at least one modulation of the ambience signal with a time-dependent function comprising a semi-periodic frequency that varies with time and is determined based on a fundamental period and a random value with a defined probability density function.

2. The system of claim 1, wherein the at least one left output signal is constructed as an additive combination of the summation signal and the ambience signal.

3. The system of claim 2, wherein the additive combination is constructed as a sum of the summation signal and the ambience signal, one or both of which is attenuated by at least one predetermined value, and one or both of which is multiplied by the time-dependent function.

4. The system of claim 1, wherein the at least one right output signal is constructed as subtractive combination of the summation signal and the ambience signal.

5. The system of claim 4, wherein the subtractive combination is constructed as a difference between the summation signal and the ambience signal, one or both of which is attenuated by at least one predetermined value, and one or both of which is multiplied by a negation of the time-dependent function.

6. The system of claim 3 or 5, wherein one or more of the at least one predetermined value, the random value, the defined probability density function, or a fundamental period for the at least one time-dependent function is configurable based on input received by the audio enhancement component.

7. The system of claim 3 or 5, wherein one or more of the at least one predetermined value, the random value, the defined probability density function, or a fundamental period for the at least one time-dependent function is equivalent for both the left output signal and the right output signal.

8. The system of claim 1, wherein a second left output signal from the at least one left output signal is constructed as an additive combination of the left channel signal of the source stereo signal and a function of the ambience signal multiplied by the time-dependent function.

9. The system of claim 1, wherein a second right output signal from the at least one right output signal is constructed as a subtractive combination of the right channel signal of the source stereo signal and a function of the ambience signal multiplied by a negation of the time-dependent function.

10. The system of claim 1, wherein a third left output signal from the at least one left output signal is constructed as a function of the ambience signal multiplied by the time-dependent function; and wherein a third right output signal from the at least one right output signal is constructed as a negative function of the ambience signal multiplied by a negation of the time-dependent function.

11. The system of claim 10, wherein the enhanced output signal further includes a center signal constructed as a function of the summation signal.

12. The system of claim 1, wherein the enhanced output signal further includes at least one of a first lower left output signal or a first upper left output signal constructed based upon a slow-varying periodic function applied to an additive combination of a function of the summation signal and a function of the ambience signal multiplied by the time-dependent function.

13. The system of claim 1, wherein the enhanced output signal further includes at least one of a first lower right output signal or a first upper right output signal constructed based upon a slow-varying periodic function applied to a subtractive combination of a function of the summation signal and a function of the ambience signal multiplied by a negation of the time-dependent function.

14. The system of claim 1, wherein the enhanced output signal further includes at least one of a second lower left output signal or a second upper left output signal constructed based upon a slow-varying periodic function applied to an additive combination of the left signal of the source stereo signal and a function of the ambience signal multiplied by the time-dependent function.

15. The system of claim 1, wherein the enhanced output signal further includes at least one of a second lower right output signal or a second upper right output signal constructed based upon a slow-varying periodic function applied to a subtractive combination of the right signal of the source stereo signal and a function of the ambience signal multiplied by a negation of the time-dependent function.

16. The system of claim 1, wherein the enhanced output signal further includes at least one of a third lower left output signal or a third upper left output signal constructed based upon a slow-varying periodic function applied to a function of the ambience signal multiplied by the time-dependent function.

17. The system of claim 1, wherein the enhanced output signal further includes at least one of a third lower right output signal or a third upper right output signal constructed based upon a slow-varying periodic function applied to a negative function of the ambience signal multiplied by a negation of the time-dependent function.

18. The system of claim 1, wherein the fundamental period is greater than a value of the semi-periodic frequency and the random value is less than the value of the semi-periodic frequency.

19. The system of claim 17, wherein the slow-varying periodic function is selected from slow-varying periodic functions that are equivalent, and at least one slow-varying periodic function, of the slow-varying periodic functions, is different in polarity than another slow-varying periodic function of the slow-varying periodic functions.

20. A method, comprising:

receiving, by a device comprising a processor, a summation signal generated as a sum of a left source signal of a source signal and a right source signal of the source signal;

receiving, by the device, an ambience signal generated as a difference between the left source signal and the right source signal; and electronically generating, by the device, an enhanced output signal including at least one channel pair comprising a left output signal and a right output signal, wherein the generating the enhanced output signal is based upon at least one modulation of the ambience signal with a time-varying function comprising a semi-periodic frequency that varies with time and is determined based on a fundamental period and a random value with a defined probability density function.

21. The method of claim 20, further comprising at least one of:

generating a first left output signal by additively combining a function of the summation signal and a function of the ambience signal and multiplying by the time-varying function;

generating a first right output signal by subtracting a function of the ambience signal from a function of the summation signal and multiplying by a negation of the time-varying function;

generating a second left output signal by additively combining a function of the left source signal and a function of the ambience signal and multiplying by the time-varying function;

generating a second right output signal by subtracting a function of the ambience signal from a function of the right source signal and multiplying by a negation of the time-varying function;

generating a third left output signal by multiplying a function of the ambience signal by the time-varying function;

generating a third right output signal by multiplying a function of the ambience signal by a negation of the time-varying function; or generating a center output signal as a function of the summation signal.

22. The method of claim 21, further comprising at least one of:

configuring dynamically in real time at least one of the function of the summation signal, the function of the ambience signal, or the time-varying function;

applying equivalent values for the at least one channel pair for at least one of the function of the summation signal, the function of the ambience signal, or the time-varying function;

generating the time-varying function as a sinusoidal wave;

applying at least one distinct function to the at least one channel pair for generating an upper and a lower channel for the at least one channel pair;

formulating the at least one distinct function as a slow-varying sinusoidal wave;

formulating at least one slow-varying periodic function according to a polarity that differs from other slow-varying periodic functions; or applying an equivalent slow-varying sinusoidal wave to the at least one channel pair.

23. A method, comprising:

receiving, by a system comprising a processing device, a source stereo signal comprising a left source signal and a right source signal;

generating, by the system, a summation signal as a sum of the left source signal and the right source signal;

generating, by the system, an ambience signal as a difference between the left source signal and the right source signal; and electronically generating, by the system, an enhanced output signal including at least one channel pair comprising a left output signal and a right output signal, wherein the generating the enhanced output signal is based on at least one modulation of the ambience signal with a time-varying function comprising a semi-periodic frequency that varies with time and is determined based on a fundamental period and a random value with a defined probability density function.

24. The method of claim 23, further comprising at least one of:

generating a first left output signal by additively combining a function of the summation signal and a function of the ambience signal multiplied by the time-varying function;

generating a first right output signal by subtracting a function of the ambience signal from a function of the summation signal multiplied by a negation of the time-varying function;

generating a second left output signal by additively combining a function of the left source signal and a function of the ambience signal multiplied by the time-varying function;

generating a second right output signal by subtracting a function of the ambience signal from a function of the right source signal multiplied by a negation of the time-varying function;

generating a third left output signal as a function of the ambience signal multiplied by the time-varying function;

generating a third right output signal as a function of the ambience signal multiplied by a negation of the time-varying function; or generating a center output signal as a function of the summation signal.

25. The method of claim 24, further comprising at least one of:

configuring dynamically in real time at least one of the function of the function of the summation signal, the function of the ambience signal, or the time-varying function;

applying equivalent values for the at least one channel pair for at least one of the function of the summation signal, the function of the ambience signal, or the time-varying function;

generating the time-varying function as a sinusoidal wave;

applying at least one distinct function to the at least one channel pair for generating an upper and a lower channel for each of the at least one channel pair;

formulating the at least one distinct function as a slow-varying sinusoidal wave;

formulating at least one slow-varying periodic function according to a polarity that differs from other slow-varying periodic functions; or applying an equivalent slow-varying sinusoidal wave to each of the at least one channel pair.

* * * * *